United States Patent [19]

Long

[11] 3,995,131

[45] Nov. 30, 1976

[54] SWITCH MOUNTING FOR MARKING INSTRUMENT

[76] Inventor: John C. Long, 90 Broad St., P.O. Box 242, Charleston, S.C. 29402

[22] Filed: Feb. 3, 1975

[21] Appl. No.: 546,451

[52] U.S. Cl. ..... 200/157; 200/61.58 R; 200/243

[51] Int. Cl.[2] ..... H01H 9/06

[58] Field of Search..... 200/157, 61.58 R, 61.59, 200/61.42, 243, 60, 52, 52 R, 52 A; 235/64; 179/146 R

[56] References Cited

UNITED STATES PATENTS 1,107,645 8/1914 Benedict ..... 200/60

3,326,188 6/1967 Long ..... 179/146 R

*Primary Examiner*—James R. Scott
*Assistant Examiner*—Morris Ginsburg
*Attorney, Agent, or Firm*—Strauch, Nolan, Neale, Nies & Kurz

[57] ABSTRACT

A generally C-shaped clip of electrically insulating material adapted for detachable connection to a pencil or the like mounts a switch comprising spaced contacts in the form of the bared ends of a conductor cord having on its other end a jack for connection to a recorder, and a metal sleeve is slidable along the clip between a switch-on position bridging the contacts and a remote switch-on position.

7 Claims, 5 Drawing Figures

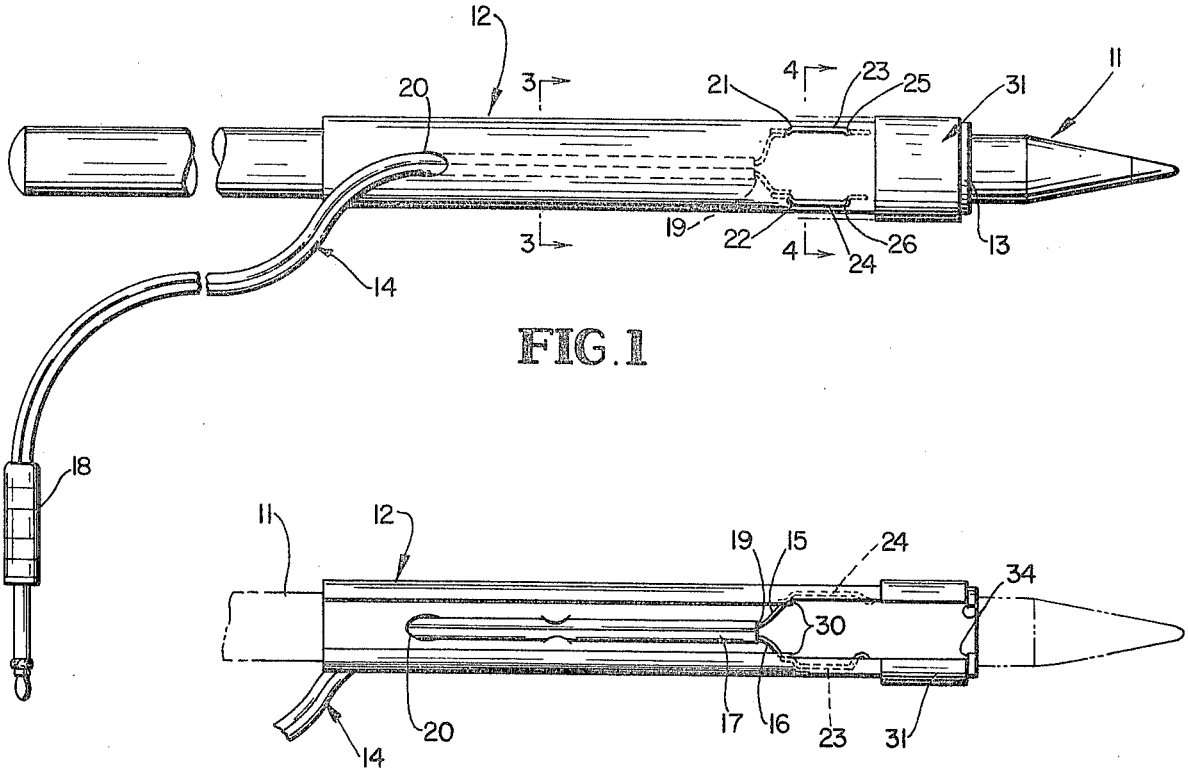
FIG. 1
FIG. 2
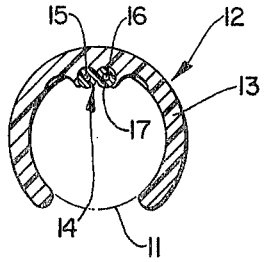
FIG. 3
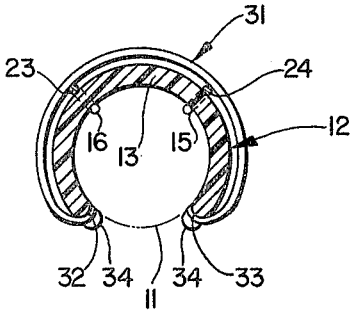
FIG. 4
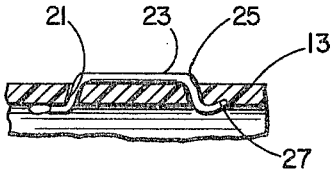
FIG. 5

SWITCH MOUNTING FOR MARKING INSTRUMENT

This invention relates to a switch assembly mounted on a writing or like marking instrument and particularly to such a switch incorporated into a detachable clip-like holder and adapted for connection to a dictating machine or other recorder.

The present invention contemplates a novel switch structure and an improved arrangement for mounting the switch on a marking instrument or a writing instrument holder, and this is a major object of invention.

A further object of the invention is to provide in novel association a clip for detachably mounting upon a pencil or the like, and a special switch on the mounting connected in circuit with a cord having a jack or the like at a free end for electrical connection to a dictating instrument or like recorder.

Another object of the invention is to provide a novel switch structure for a marking instrument clip that is simple in structure and has only one movable part located in ready access to a finger of a person holding the marking instrument.

Further novel features and other objects of this invention will become apparent from the following detailed description, discussion and the appended claims taken in conjunction with the accompanying drawings.

In my prior U.S. Pat. No. 3,326,188 I disclose a pencil holder that carries a microphone and a switch in the electrical cord for connecting the microphone to a recorder.

BRIEF DESCRIPTION OF DRAWINGS

FIG. 1 is a top plan view showing an embodiment of the invention mounted on a marking instrument;

FIG. 2 is a bottom plan view of the switch mounting clip assembly of FIG. 1 showing the internal wiring, and illustrating the writing instrument only in phantom lines;

FIG. 3 is a rear sectional view of the mounting clip;

FIG. 4 is a section substantially on line 4—4 of FIG. 1; and

FIG. 5 is an enlarged fragmentary detail in section showing the secured end of a contact wire.

PREFERRED EMBODIMENTS

FIG. 1 shows a marking instrument such as a cylindrical pencil 11 having a switch mounting clip assembly 12 detachably assembled with it.

The clip assembly comprises a generally C-shaped body 13 of stiff but resilient plastic, the curved cross section of which extends for at least slightly greater than 180° and has an effective radius such that when slipped over the end of the pencil it will frictionally maintain itself in a desired position along the pencil due to its inherent resiliency. Body 13 is preferably a preformed integral element of electrically insulating plastic material.

An electrical cord 14 comprising metal conductor wires 15 and 16 surrounded and spaced by electrical insulation 17 has at its outer free end a jack 18 for connection to a conventional dictating machine or other recorder. The other end of cord 14 is threaded through an opening 20 in body 13 and extends longitudinally along the inner surface of the body to a conductor separation point 19 where the insulation is removed the respective bare wires are extended outwardly through adjacent openings 21 and 22 in the body 13.

After passing through holes 21 and 22, the wires extend externally longitudinally of the body as substantially parallel contact elements 23 and 24, and then the wire ends are passed through spaced body openings 25 and 26 back into the interior of body 13. As shown in FIG. 5 for one of the wires, each wire terminal 27 is suitably anchored internally within the body 13.

Contact elements 23 and 24 are usually circumferentially spaced about 90° and they are fixed in the assembly. A metal conductor sleeve 31 is movable between a switch-off position shown in full lines in FIG. 1 and a switch-on position bridging contacts 23 and 24 as indicated in dotted lines in FIG. 1. As shown in FIG. 2 slidable movement of the sleeve 31 to switch-on position is limited by contact with stop shoulders 30 on the body.

Sleeve 31 is preferably a C-shaped element of thin sheet metal sized and shaped to slide snugly along the outer surface of body 13, its opposite ends 32 and 33 being turned to overlie the opposite parallel longitudinally edges of body 13 as shown in FIG. 4 whereby sleeve 31 may freely slide along the body but cannot rotate or become separated from the body. In a preferred embodiment sleeve 31 is an integral formed element of thin copper which is bendable to a desired contour of inherent resiliency. As shown in FIG. 2 one or more integral stop formations 34 may be formed on the front end of body 13 to prevent sleeve 31 from sliding off the body at that end after it has been moved to switch-off position.

In practice, see FIGS. 4 and 5, the contact element portion of each wire initially may be bowed slightly outwardly from the outer surface of body 13, but since the wires are of quite small diameter and highly flexible, this offers no obstruction to sleeve 31 sliding to bridge them. Actually the inherent resiliency of the wires themselves and the resiliency of the sleeve 31 combine to provide a spring action that permits the sleeve 31 to slide easily over the contact elements and be frictionally resiliently maintained in contact bridging position thereon.

Similarly the size of cord 14 is such that the portion of it which is trapped between body 13 and the writing instrument as indicated in FIG. 3 offers little resistance to sliding assembly of the body on the writing instrument, and once the clip is positioned the wedging action of the cord helps maintain that position.

Where the writing instrument is a wooden pencil or otherwise presents an electrically insulating surface the wires may be merely bared at junction 19 and extended through the body. However where the pencil or pen surfaces may be electrically conductive, the wires will be covered with insulation except in the external lengths comprising the contact elements 23 and 24.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A switch mounting clip adapted for mounting on a marking instrument comprising a body of arcuate cross section having an inner surface and a smooth, uninterrupted outer surface and adapted for frictional grip positioning on said instrument, switch means on said body comprising a pair of external contacts upon the body surface and a conductive connector member slidable on the body between a self-maintaining, switch-on position frictionally bridging said contacts and a switch-off position clear of said contacts, and an insulated conductor cord attached to said body having conductor wires at one end connected to said contacts.

2. The switch mounting clip defined in claim 1, wherein said body is electrically insulating and said contacts are bared end regions of said conductor wires.

3. The switch mounting clip defined in claim 2, wherein said conductor cord passes through an opening in said body to pass along the inner surface of said body and said bared end regions of the conductor wires extend out of the body to lie adjacently therealong and provide said contacts.

4. The switch mounting clip defined in claim 1, wherein said body is an integral synthetic plastic element generally C-shaped in cross section.

5. The switch mounting clip defined in claim 1, wherein said body is electrically insulating, said contacts are longitudinally extending side by side conductors and said connector member is a metal sleeve having an arcuate cross section corresponding to that of said body.

6. The switch mounting clip defined in claim 1, wherein an electrical plug is provided at the outer end of said conductor cord.

7. The switch mounting clip defined in claim 5, wherein means is formed in said body limiting sliding movement of said sleeve beyond said positions.

* * * * *